United States Patent [19]

Wiktor

[11] 4,168,407

[45] Sep. 18, 1979

[54] ELECTRICAL SWITCH ASSEMBLY INCLUDING A SEPARATE INTERRUPTER SWITCH

[75] Inventor: Dominik M. Wiktor, Cranford, N.J.

[73] Assignee: Automatic Switch Company, Florham Park, N.J.

[21] Appl. No.: 854,189

[22] Filed: Nov. 23, 1977

[51] Int. Cl.[2] ..... H01H 3/00

[52] U.S. Cl. ..... 200/18; 200/50 C; 200/153 R

[58] Field of Search ..... 200/1 R, 1 U, 5 R, 11 R, 200/11 B, 11 C, 11 D, 11 E, 11 G, 11 J, 11 K, 11 TW, 17 R, 18, 14, 17 A, 50 C, 153 R, 0.5–19.50

[56] References Cited

U.S. PATENT DOCUMENTS

| | | | |
|---|---|---|---|
| 2,513,677 | 7/1950 | Rigert | 200/11 B |
| 2,576,836 | 11/1951 | Hilsinger, Jr. | 200/14 X |
| 2,821,580 | 1/1958 | Black | 200/14 X |
| 3,121,143 | 2/1964 | Landry et al. | 200/11 G |
| 3,189,695 | 6/1965 | Randolph | 200/11 D |
| 3,189,696 | 6/1965 | Nuttall | 200/14 X |
| 3,639,706 | 2/1972 | Purdy | 200/17 R |
| 3,697,709 | 10/1972 | Witkov | 200/48 |
| 3,767,872 | 10/1973 | Whitchurch | 200/18 X |

*Primary Examiner*—James R. Scott

*Attorney, Agent, or Firm*—Alan H. Levine

[57] ABSTRACT

An electrical switch assembly including a plurality of main electrical switches, an operating device for opening and closing the main switches, and a single interrupter switch connected in parallel with the main switches and operable by the operating device. The interrupter switch opens only after any of the main switches opens, so that the single interrupter switch serves as the arcing contacts for all of the main switches. The operating device may include a shaft which is rotatable to operate the main switches and which is shiftable longitudinally to operate the interrupter switch. The shaft may carry a radially projecting follower pin slidable within a fixed guide slot shaped to insure the desired sequence of operation of the plurality of main switches and the interrupter switch. The interrupter switch, which may be a conventional circuit breaker, is a self-contained unit physically separate from the main switches. The main electrical switches may include a plurality of separate stationary contacts and a single main movable contact for alternatively engaging any one of the stationary contacts. An intermediate movable contact moves with the main movable contact and disengages each stationary contact only after it has been disengaged by the main movable contact. The interrupter is electrically connected between the main and intermediate movable contacts.

11 Claims, 8 Drawing Figures

ELECTRICAL SWITCH ASSEMBLY INCLUDING A SEPARATE INTERRUPTER SWITCH

BACKGROUND OF THE INVENTION

This invention relates to an electrical switch assembly, and more particularly to a switch assembly used to carry large enough electrical loads so that arcing between switch contacts as they open is a factor to be dealt with.

Conventionally, a switch assembly of this type includes pairs of main contacts, one contact of each pair being stationary and the other movable, and pairs of arcing contacts, one arcing contact of each pair being stationary and the other movable. Each main stationary contact ordinarily carries a stationary arcing contact, and each movable main contact ordinarily carries a cooperable movable arcing contact. The pair of arcing contacts is designed to open only after the pair of main contacts open, so that no arc is drawn between the main contacts when they open, but instead the arc is drawn between the arcing contacts. Hence, any deterioration caused by the arc is limited to the arcing contacts which thereby protect the main contacts. Normally, therefore, as many pairs of arcing contacts are furnished as there are main contact pairs, and ordinarily are quenching means are provided for each pair of arcing contacts to extinguish the arc as quickly as possible.

It is an object of the present invention to provide an electrical switch assembly of reduced size and expense by eliminating the need for a separate pair of arcing contacts and a separate quenching means for each pair of main contacts.

It is another object of the invention to provide an electrical switch assembly in which only a single interrupter switch serves as the arcing contacts for all the pairs of main contacts, regardless of how many main contact pairs are present.

It is a further object of the invention to provide such a switch assembly in which the interrupter switch is a self-contained unit and physically separate from the main contacts, so that the interrupter switch can be removed from the switch assembly, for repair or replacement, without disturbing the main contacts and hence without the need to remove the switch assembly from service.

It is an additional object of the invention to provide such an assembly including an intermediate movable contact, movable with the main movable contact of the switch assembly, which maintains each circuit closed after the main movable contact separates from each stationary contact and before the circuit is opened by the interrupter switch.

BRIEF DESCRIPTION OF THE DRAWINGS

Additional objects and features of the invention will be apparent from the following description, in which reference is made to the accompanying drawings.

In the drawings.

DESCRIPTION OF THE PREFERRED EMBODIMENT

Figure 1:
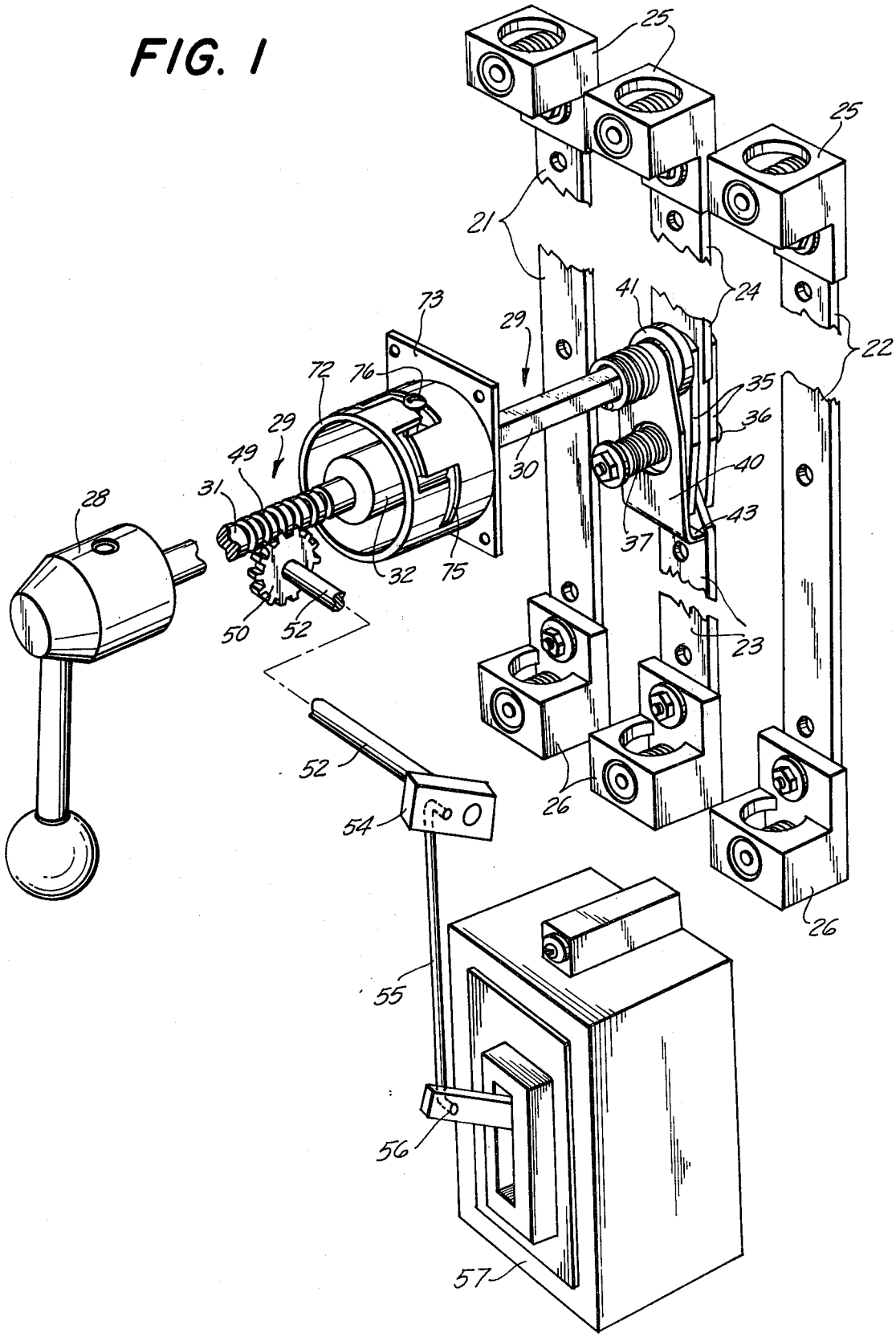
FIG. 1 is perspective view of a switch assembly according to the present invention, frame parts having been eliminated for clarity.

The invention will be described in connection with a bypass switch, which is a type of switch used in association with an automatic transfer switch. A combination bypass and isolation switch is described in U.S. Pat. No. 3,697,709, and a bypass switch is shown together with an automatic transfer switch in copending application Ser. No. 843,387, filed Oct. 19, 1977. An automatic transfer switch is used to connect an electrical load to a normal source of power, such as an electric utility, and in the event the normal source fails, to automatically disconnect the load from the normal source and connect it to an emergency source, such as a local generator driven by a gasoline engine. Upon resumption of the normal source the automatic transfer switch automatically disconnects the load from the emergency source, which can then be shut down, and reconnects the load to the normal source.

Since the transfer switch must be serviced from time-to-time, it is common to connect it to the load and two power sources through a bypass switch. When desired, the bypass switch can be shifted to connect the load directly to either power source, thereby bypassing the transfer switch and permitting it to be isolated without disturbing continuity of power to the load. The present invention is useful with many types of switches, including automatic transfer switches and bypass switches. In the following description, the bypass switch is used simply as an example of a switch having a plurality of main switches, in this case three, combined with a single interrupter switch capable of serving as the arcing contacts for all three main switches in a case where the bypass switch is used for load switching purposes.

The switch chosen to illustrate this invention includes a stationary flat base 10 (FIG. 2) to which a pair of parallel channel-shaped bars 11 are fixed, as by bolts 12. Bars 11 support a stationary framework comprising four relatively long posts 13 (only two being visible in FIG. 2), projecting perpendicularly with respect to base 10, which carry four parallel spaced-apart platforms 14, 15, 16, and 17.

Mounted on platform 14, by means of short posts 20, are two relatively long electrically conductive bars 21 and 22, and two relatively short electrically conductive bars 23 and 24, the latter two bars being longitudinally aligned and spaced apart. Bars 21, 22 and 23 are three stationary contacts of three main switches, and bar 24 serves to pivotally support a main movable contact to be described below. Mounted on the ends of bars 21, 22, and 24 are three terminals 25 for connecting the bars to a normal source of electric power, to a load, and to an emergency source of electric power, respectively. Mounted on the opposite ends of bars 21 and 22, and on the end of bar 23, are three terminals 26 for connecting the bars to the stationary normal source contacts, the movable load contacts, and the stationary emergency source contacts, respectively, of an automatic transfer switch.

Extending through aligned holes in platforms 15, 16, and 17 is a shaft 29 (FIGS. 1–3), the shaft being both rotatable and slidable longitudinally with respect to the platforms. Shaft 29 has three aligned parts, namely, a rod 30, a rod 31, and a coupling 32 non-rotatably joining the two rods. A handle 28, for rotating and longitudinally moving rod 29 is fixed to the left end, as viewed in FIGS. 1-3, of rod 31. Rod 30 has a square cross-sectional shape, and near its rightward end, as viewed in FIGS. 1-3, the rod passes rotatably through a hole 33 in bar 24. Rod 30 also passes non-rotatably, but slidably, through a square hole 34 in each of two main movable contacts 35, one contact 35 being arranged against each face of bar 24. As a result, contacts 35 are rotatable with rod 30 and hence with the entire shaft 29.

Figure 3:
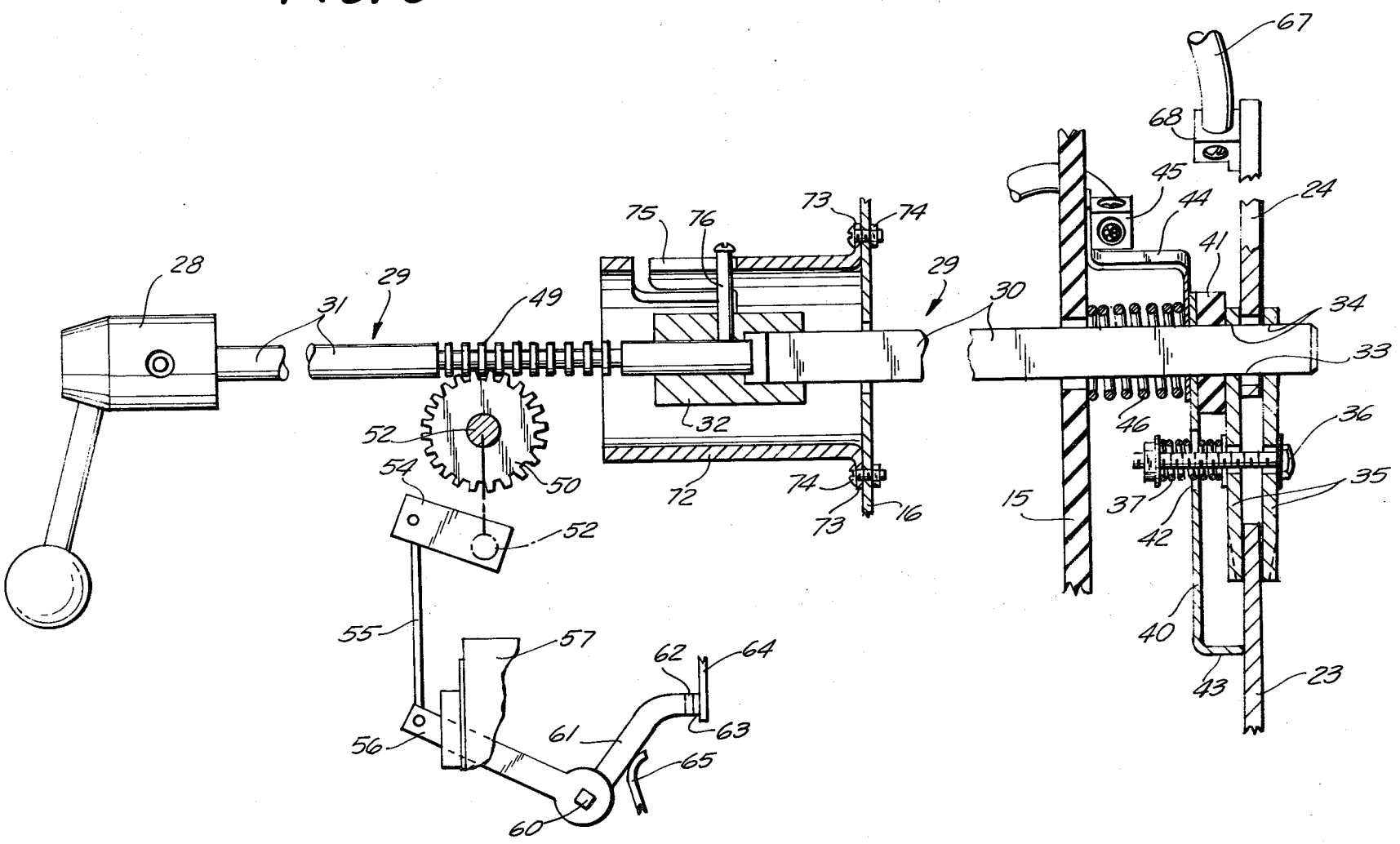
FIG. 3 is longitudinal cross-sectional view through the switch assembly.

In FIGS. 1 and 3, movable contacts 35 are seen sandwiching stationary contact 23 between them to electrically connect contact 23 to bar 24. If handle 29 is rotated 90° in one direction from this position, movable contacts 35 disengage stationary contact 23 and engage stationary contact 22 by sandwiching the latter between them, thereby electrically connecting contact 22 and bar 24. If handle 29 is rotated 90° in the other direction from the position shown, movable contacts 35 sandwich between them stationary contact 21 to connect that contact to bar 24. Thus, at any one time, movable contacts 35 can engage only one of the three stationary contacts 21-23, and hence form the movable contacts of three main switches. A bolt 36 passes through aligned holes in contacts 35 and a compression spring 37 surrounds the bolt, and by pressing against a nut threaded on the bolt constantly urges the contacts 35 toward each other. Spring 37 thereby insures good contact pressure between the movable contacts and any one of stationary contacts sandwiched between them.

Rod 30 passes non-rotatably, but slidably, through a square hole in an L-shaped intermediate movable contact 40. A washer 41 of insulator material surrounds rod 30 between contact 40 and one of the contacts 35. Contacts 35 and 40 all rotate together when shaft 29 is rotated. Contact 40 is provided with an enlarged hole 42 through which bolt 36 and spring 37 pass. The edge of the bent free end 43 of contact 40 is adapted to engage any one of the three stationary contacts 21-23 depending on the angular position of shaft 29, as described above with respect to movable contacts 35. Free end 43 of intermediate contact 40 is wider than main movable contacts 35. As a result, when shaft 29 is rotated to open one of the main switches intermediate contact 40 remains in engagement with the stationary contact of that switch longer than movable contacts 35, the reason for which will be described below.

One end of a thin S-shaped contact strip 44 is positioned against the face of intermediate movable contact 40 opposite insulator washer 41, and the other end of strip 44 is electrically connected to a terminal 45 (FIGS. 2 and 3) mounted on one face of platform 15. Contact strip 44 has a hole through which rod 30 rotatably passes. A compression spring 46 surrounds rod 30 and is seated at one end against platform 15 and at the other end against contact strip 44. Compression spring 46 maintains strip 44, contact 40, insulator 41, and one of the contacts 35 tightly against bar 24 regardless of the longitudinal position of shaft 29.

Figure 2:
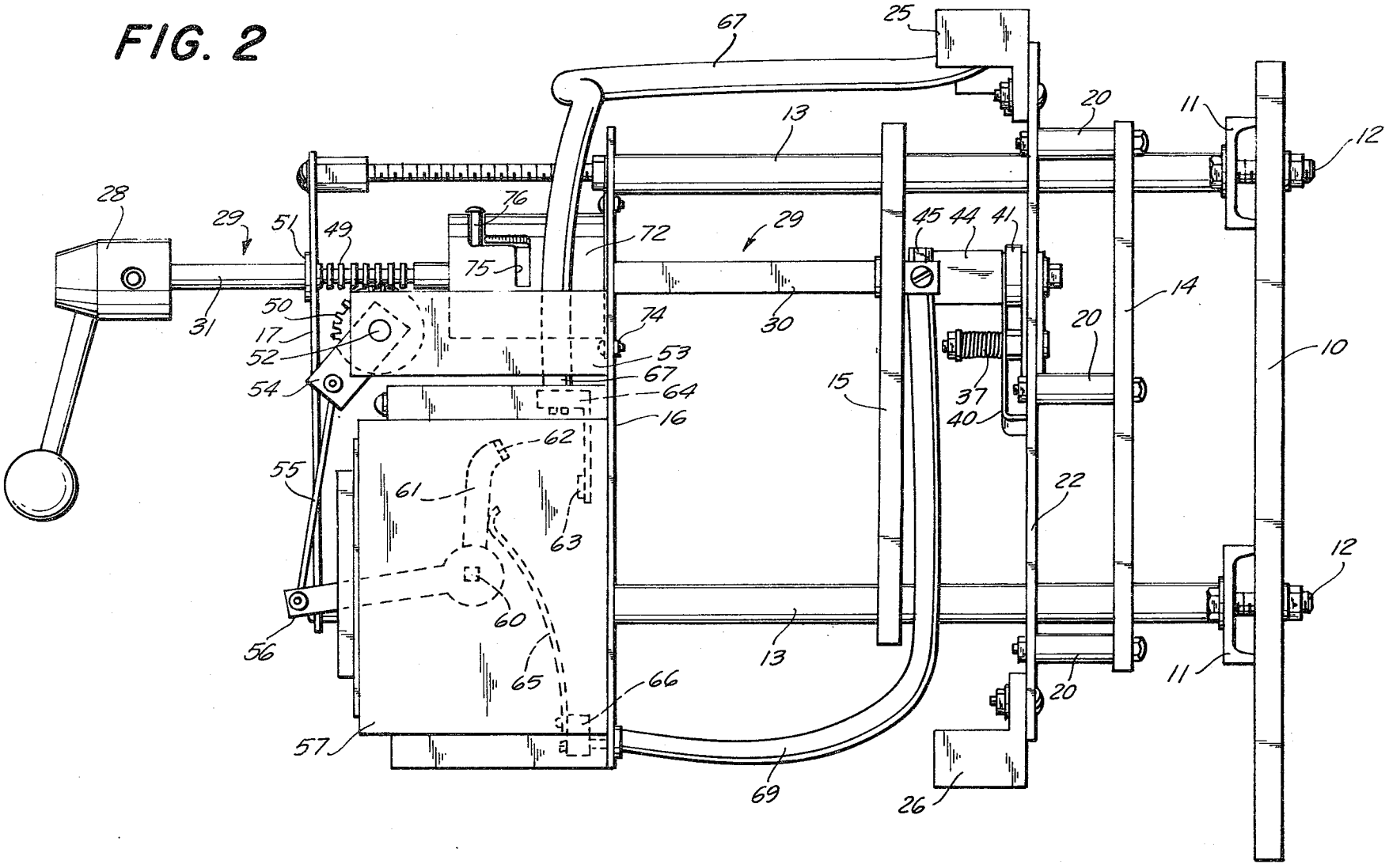
FIG. 2 is a side elevational view of the switch assembly.

Rod 31 of shaft 29 has a circular cross-sectional shape and passes snugly but movably through a bushing 51 (FIG. 2) within a hole in platform 17, the bushing serving as a bearing for the rod. Rod 31 is formed with a series of annular teeth defining a rack 49 (FIGS. 1-3). The rack meshes with a pinion 50 mounted on a rotatable shaft 52 supported between two brackets 53 (only one being visible in FIG. 2) secured to and projecting perpendicularly from platform 16. Fixed to and rotatable with shaft 52 is an arm 54 pivotally connected by a link 55 to the actuating arm 56 of an interrupter switch 57.

Interrupter switch 57 may be a conventional circuit breaker including a rotatable square shaft 60 upon which actuator arm 56 is mounted. Also mounted on shaft 60 is a movable contact arm 61 carrying a movable contact 62. Fixed within the housing of interrupter switch 57 is a stationary contact 63 carried by a terminal block 64. A flexible electrically conductive strip 65 electrically connects contact arm 61 and hence movable contact 62 to another terminal block 66 fixed within the interrupter switch housing. A cable 67 electrically connects terminal 64 to a terminal 68 (FIG. 3) fixed to bar 24; thus, stationary contact 63 of the interrupter switch is continuously electrically connected to the main movable contacts 35. Another cable 69 electrically connects terminal 66 to terminal 45; thus, movable contact 62 of the interrupter switch is continuously electrically connected to the movable intermediate contact 40.

Interrupter switch 57 has two conditions, namely, an open condition shown in FIG. 2, wherein contacts 62 and 63 are separated, and a closed condition shown in FIG. 3, wherein contacts 62 and 63 are engaged. The condition of interrupter switch 57 is controlled by the longitudinal position of shaft 29. When shaft 29 is pulled toward the left in FIGS. 2 and 3, rack 49 rotates pinion 50 in a counterclockwise direction. Shaft 52 and arm 54 rotate in the same direction, and through link 55 arm 54 moves actuator 56 counterclockwise in FIG. 2. This causes counterclockwise movement of shaft 60 and hence of movable contact arm 61 so that interrupter switch 57 opens. Upon pushing shaft 29 to the right in FIGS. 2 and 3, rack 49 causes clockwise rotation of pinion 50, thereby producing similar rotation of shaft 52 and arm 54. Actuator arm 56 is thereby moved clockwise through link 55 causing similar movement of shaft 60 and hence of movable contact arm 61 so that interrupter switch 57 closes.

Surrounding shaft 29 is a short rigid tube 72 (FIGS. 1-3) having an outwardly-projecting flange 73 at one end fixed to platform 16, as by machine screws and nuts 74. Formed in the upper half of tube 72 (as viewed in the drawings) is a cam slot 75 having a series of mutually perpendicular portions some of which are parallel to the rotational direction of movement of shaft 29, and some of which are parallel to the longitudinal direction of movement of shaft 29. Projecting radially from coupling 32 of shaft 29, and slidable within cam slot 75, is a headed pin 76. Pin 76 is held captive within slot 75, and hence shaft 29 is constrained to move only in a pattern conforming to the shape of slot 75.

Figure 4:
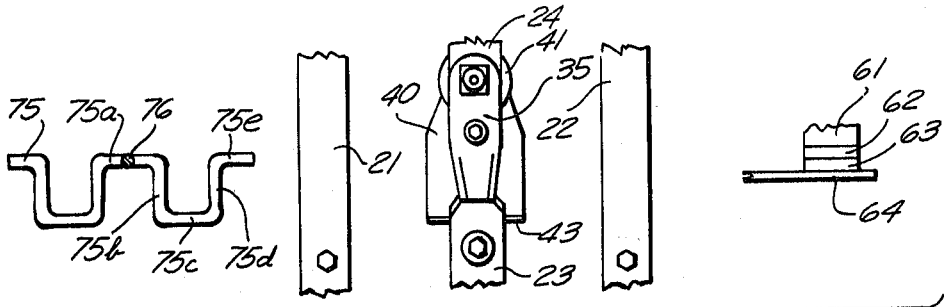
FIGS. 4–8 are schematic representations showing the relationship between certain parts of the switch assembly during a particular sequence of operation.

In FIGS. 1, 3, and 4, the parts are shown in a position in which main movable contacts 35 and intermediate movable contact 40 engage main stationary contact 23. Thus, the main switch including stationary contact 23 is closed, and each of the switches including stationary contacts 21 and 22 is open. In this condition, pin 76 is at the midpoint of cam slot portion 75*a* and contacts 62 and 63 of interrupter switch are engaged.

Figure 5:
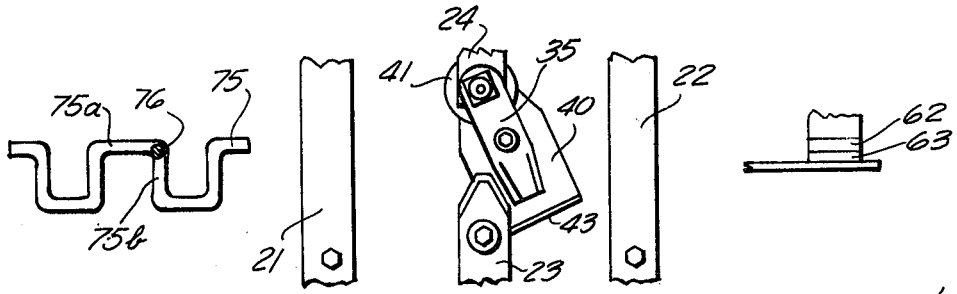

Assume now that it is desired to open main switch including contact 23 and close main switch including contact 22. Handle 28 is rotated in a direction to swing movable contacts 35 and 40 toward stationary contact 22. Rotation continues until pin 76 reaches the corner of slot 75, as shown in FIG. 5 where slot portions 75*a* and 75*b* meet. At this point, movable contacts 35 are separated from stationary contact 23, but intermediate movable contact 40 still engages contact 23. Hence, the circuit from contact 23 to bar 24 is still completed through contact 40, strip 44 (FIG. 2), terminal 45, cable 69, contacts 62 and 63 of the interrupter switch, cable 67, and terminal 68. Interrupter switch 57 is still closed because shaft 29 has only been rotated and not moved longitudinally.

Figure 6:
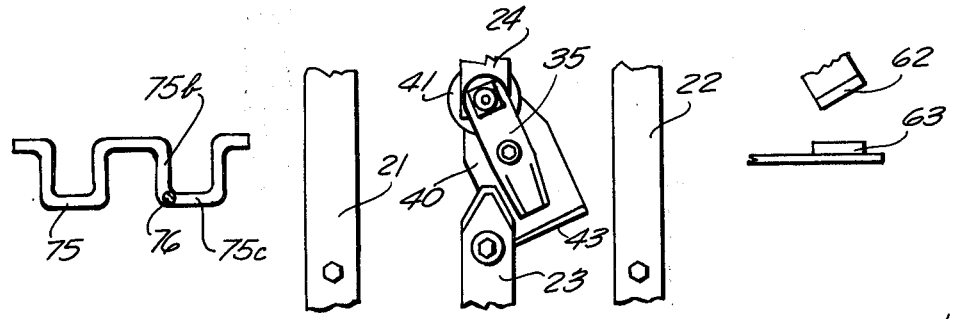
Figure 7:
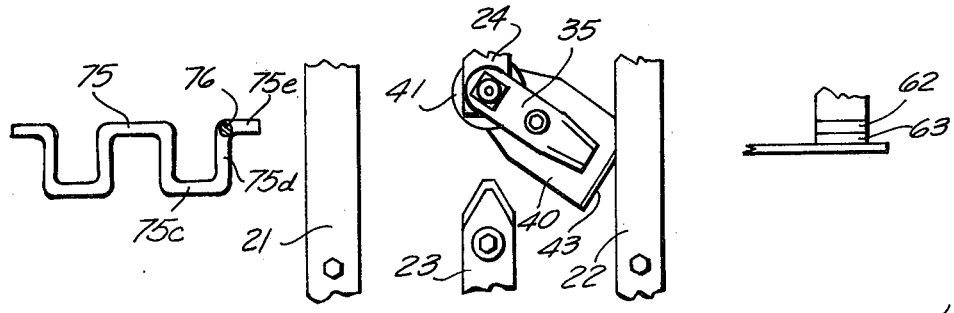
Figure 8:
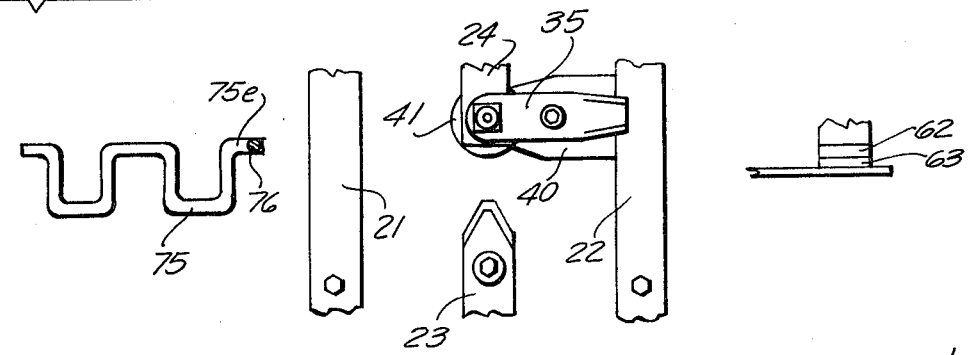

Next, handle 28 is pulled toward the left to the position shown in FIG. 2, so that the parts assume the condition shown in FIGS. 2 and 6. Pin 76 has moved along slot portion 75*d* to the intersection of slot portions 75*b* and 75*c*. Movable contacts 35 and 40 remain as in FIG. 5, because there has been no rotation of shaft 29. However, the longitudinal movement of shaft 29 has caused interrupter switch contacts 62 and 63 to separate and open the circuit. During this separation, an arc is drawn between the contacts 62 and 63. All circuits are now open. Shaft 29 can now be further rotated, until pin 76 reaches the next corner of slot 75, where slot portions 75*c* and 75*d* meet, whereupon shaft 29 can then be pushed toward the right in FIGS. 2 and 3 to bring the parts to the condition shown in FIG. 7 in which pin 76 is at the intersection of slot portions 75*b* and 75*e*. The rotation of shaft 29 has brought intermediate movable contact 40 into engagement with stationary contact 22, and longitudinal movement of shaft 29 has caused contacts 62 and 63 of the interrupter switch to close. Hence, a circuit including contact 22 and bar 24 is completed. Shaft 29 is then permitted a final amount of rotation in which pin 76 moves to the end of slot portion 75*e*, as shown in FIG. 8, and main movable contacts 35 engage main stationary contact 22.

When it is desired to open the switch including stationary contact 22 and close switch including stationary contact 23, the movements described above are reversed. Again, main movable contacts 35 disengage stationary contact 22 before intermediate movable contact 40 disengages that contact, after which interrupter switch contacts 62 and 63 separate to open the circuit and draw an arc between them. If thereafter, it is desired to open the switch including contact 23 and close the switch including contact 21, the movements described above with respect to FIGS. 4–8 are followed, except handle 28 is rotated in the opposite direction from that described.

It will be appreciated that each time movable contacts 35 are moved to open a main switch, interrupter switch contacts 62 and 63 open only after movable contacts 35 disengage the stationary contact 21–23 of the main switch. Hence, the single pair of contacts 62 and 63 serve as the arcing contacts for all three main switches.

The invention has been described in connection with a single phase switch. Where a three phase switch is employed, a separate pair of contacts of a three phase interrupter switch 57 is furnished for each phase, i.e., three interrupter contact pairs are provided. Each interrupter contact pair serves as the arcing contacts for all the switches of its phase.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

What is claimed is:

1. An electrical switch assembly comprising:

(a) a plurality of main stationary contacts, (b) main movable contact means engageable with only one of said main stationary contacts at any one time, (c) operating means for selectively moving said main movable contact means into engagement with said main stationary contacts, (d) intermediate contact means movable with said main movable contact means and engageable with the same main stationary contact engaged by said main movable contact means, (e) a single interrupter switch connected in series with said intermediate contact means, said series connected interrupter switch and intermediate contact means being connected in parallel with said main movable contact means and the main stationary contact engaged by said main movable contact means, and (f) means responsive to movement of said operating means for opening said interrupter switch only after said main movable contact means disengages a main stationary contact but before said intermediate contact means disengages that main stationary contact.

2. An electrical switch assembly as defined in claim 1 wherein said interrupter switch is electrically connected between said main movable contact means and said movable intermediate contact.

3. An electrical switch assembly as defined in claim 1 wherein said responsive means closes said interrupter switch only after said intermediate contact engages one of said main stationary contacts but before said main movable contact means engages that main stationary contact.

4. An electrical switch assembly as defined in claim 1 wherein said operating means includes a shaft mounted for both rotational movement and for longitudinal movement, said main contacts opening and closing in response to one of said type of shaft movement, and said responsive means for opening said interrupter switch responding to the other type of shaft movement.

5. An electrical switch assembly as defined in claim 4 including guide means for permitting only one type of shaft movement at any one time.

6. An electrical switch assembly as defined in claim 5 wherein said guide means includes a fixed guide slot and a follower, carried by said shaft, slidable within said slot.

7. An electrical switch assembly as defined in claim 6 wherein said guide slot includes mutually perpendicular portions parallel to the rotational and longitudinal directions of movement, respectively, of said shaft.

8. An electrical switch assembly as defined in claim 1 wherein said operating means includes a shaft mounted for both rotational movement and for longitudinal movement, said main movable contact means is movable in response to one of said types of shaft movement, and said interrupter switch includes a movable contact movable by said responsive means in response to the other type of shaft movement.

9. An electrical switch assembly as defined in claim 8 wherein both of said movable switch contacts are mounted for pivotal movement, and including means operatively connected between said shaft and said movable contact responsive to longitudinal shaft movement for converting longitudinal shaft movement into pivotal movement.

10. An electrical switch assembly as defined in claim 9 wherein said converting means includes a rack and pinion combination in meshing relationship.

11. An electrical switch assembly as defined in claim 1 wherein said interrupter switch is a self-contained unit physically separate from said main contacts and contact means, whereby said interrupter switch can be removed from the switch assembly, for repair or replacement, without disturbing said main contacts and contact means.

* * * * *